US005640869A

United States Patent [19]

Takeda et al.

[11] Patent Number: 5,640,869

[45] Date of Patent: Jun. 24, 1997

[54] METHOD FOR PRODUCING ROLLED STRUCTURAL SHAPES

[75] Inventors: Shinya Takeda; Naofumi Fujie; Masaru Hoshina, all of Aichi pref., Japan

[73] Assignee: Aisin Seiki Kabushiki Kaisha, Japan

[21] Appl. No.: 567,990

[22] Filed: Dec. 4, 1995

[30] Foreign Application Priority Data

Dec. 7, 1994 [JP] Japan ..... 6-303717

[51] Int. Cl.[6] ..... B21D 5/14

[52] U.S. Cl. ..... 72/129; 72/181; 225/2; 225/3

[58] Field of Search ..... 72/129, 181, 338, 72/339, 366.2; 29/413, 414, 418, 243.58; 225/1–3, 93, 96

[56] References Cited

U.S. PATENT DOCUMENTS

| | | | |
|---|---|---|---|
| 388,995 | 9/1888 | Moxham | 72/338 |
| 2,053,375 | 9/1936 | Nicholas | 29/413 |
| 3,768,712 | 10/1973 | Imbert | 225/3 |
| 3,841,134 | 10/1974 | Falkner | 72/181 |
| 4,109,500 | 8/1978 | Franek | 225/3 |
| 4,282,996 | 8/1981 | Maeda | 225/96 |
| 4,959,986 | 10/1990 | Kranis | 72/129 |
| 5,088,309 | 2/1992 | Knudson . | |
| 5,090,227 | 2/1992 | Takeda et al. . | |
| 5,400,631 | 3/1995 | Benedetti | 29/413 |

FOREIGN PATENT DOCUMENTS

| | | | |
|---|---|---|---|
| 617202 | 3/1961 | Canada | 72/129 |
| 23 02 389 B2 | 7/1973 | Germany . | |
| 6-32 139 | 4/1994 | Japan . | |

*Primary Examiner*—Daniel C. Crane

[57] ABSTRACT

A method for producing a roll forming allows the hemming step and the roll-forming step to be contiguously performed in a single production line. The first ripping step (E) tears off a side edge strip along the first groove formed by the first grooving step (B) to form a first edge portion having a gradually changed sectional shape. At least the first grooving step (B) and the first ripping step (E) are performed contiguously with the roll-forming step (A) by utilizing the sheet or product conveyance force provided in the roll-forming step (A).

8 Claims, 6 Drawing Sheets

METHOD FOR PRODUCING ROLLED STRUCTURAL SHAPES

BACKGROUND OF THE INVENTION

1. Field of the invention

The present invention relates to a method for producing rolled structural shapes used in vehicle door frames and the like.

2. Description of the Related Art

Japanese Utility model laid-open No. 6 (1994)-32139 discloses a hemmed roll formed shape used as a pillar member of a vehicle door frame comprising a first support recess, a second support recess which opens opposite from the opening of the first support recess, and a flat exterior section that extends generally in the opening direction of the first and second support recesses, and that has a side edge with a gradually changing cross-sectional shape. In making this conventional product, a metal sheet is formed by a roll forming mill, for example, into an intermediate product having the first and second support recesses and a flat exterior portion, which initially, does not have the gradually changed sectional shape. In this intermediate product, the flat exterior portion is defined by layered portions of the metal sheet, and the two opposite side edges of the metal sheet are arranged stepwise at one of the sides of the flat exterior portion. Then, one of the side edge portions is cut off by a press machine, for example, to provide the flat exterior portion with desired edge configuration having the gradually changed sectional shape. The other of the side edge portions is then bent and folded along the one side edge by a roll forming mill, for example, so that the bent edge portion encloses the one edge, thus forming a side hem.

However, in this conventional method, the cutting blade of the press machine must be operated to provide edges having the gradually changing sectional shape while the workpiece is being moved at, or substantially at the sheet conveyance speed. Therefore, the method requires a mechanism for sliding the press machine along the production line and a space for the sliding of the press machine laterally, thus increasing the size of the production apparatus. This makes it difficult to conduct the step of providing edges having the gradually changing sectional shape and the roll forming step in a single continuous production line. In addition, the method requires that the side edges of a metal sheet be generally aligned at one side end of the flat exterior portion in order to form an edge having the gradually changed sectional shape. This requirement limits the variety of sectional shapes of vehicle door frames that can be produced, that is, it may be very difficult to produce an ideal sectional shape. Furthermore, since only one of the side edge portions of a metal sheet is cut by a press machine or the like, the hemming step may form a gap in the hem, more specifically, between the bend of the outer layer portion and the edge of the inner layer portion. The design quality of the flat exterior portion may be degraded. For example, parts of the flat design portion may become undesirably contoured.

SUMMARY OF THE INVENTION

It is an object of the present invention to provide a method for producing rolled structural shapes that facilitates single-line production.

According to the present invention, there is provided a method for producing a rolled structural shape and including a roll-forming step in which a sheet is bent into an intermediate sheet product having a predetermined sectional shape. A grooving step forms a first groove in a predetermined location in the sheet product while a portion of the sheet product is being processed in the roll-forming step. A first removing step removes a portion defined by the first groove from the sheet product to form a first edge portion having a gradually changing sectional shape while a portion of the sheet or the product is being processed in the roll-forming step.

Preferably, the method for producing a rolled structural shape further comprises the hem rolling step for forming a hem by bending a layer of metal over the first edge portion while a portion of the sheet product is being processed in the roll-forming step.

It is also preferred that the grooving step forms a second groove at a predetermined location on the sheet product, and that the method further comprise a step in which a second removing step removes a portion defined by the second groove from the sheet product to form a second edge portion having the gradually sectional shape while a portion of the sheet product is being processed in the roll-forming step. The hem rolling step forms a hem by bending the second edge portion along the first edge portion while a portion of the sheet product is being processed in the roll-forming step.

In a still further preferred embodiment of the method, the roll-forming step bends the sheet in such a manner that the intermediate product is provided with a first support recess having an opening, a second support recess having an opening opposite the opening of the first support recess, and a flat exterior portion where portions of the sheet are layered, the flat exterior portion extending generally in the opening directions of the first support recess and of the second support recess. A first grooving step forms a first step in one of the opposite surfaces of the layered portion of the flat exterior portion. A second grooving step forms a second groove in each of the opposite surfaces of a layered portion of the flat exterior portion, the second grooves extending near a side edge of the flat exterior portion. The first groove is more remote from said side edge of the flat exterior portion than second grooves which are spaced from the same side edge of the flat exterior portion. In addition, that side edge portion of the flat exterior portion is hemmed by the first removing step, the second removing step and the hem rolling step.

According to the invention, the first removing step removes a portion defined by the first groove from the sheet product to form a first edge portion required for hemming, by utilizing the conveyance force provided in the roll-forming step. Thus, at least the first grooving step and the first removing step can be performed contiguously with the roll-forming step in a single production line.

BRIEF DESCRIPTION OF THE DRAWINGS

The foregoing and further objects, features and advantages of the present invention will become apparent from the following description of the preferred embodiment with reference to the accompanying drawings, wherein.

DETAILED DESCRIPTION OF PREFERRED EMBODIMENT

A preferred embodiment of the present invention will be described hereinafter with reference to the accompanying drawings.

Figure 1:
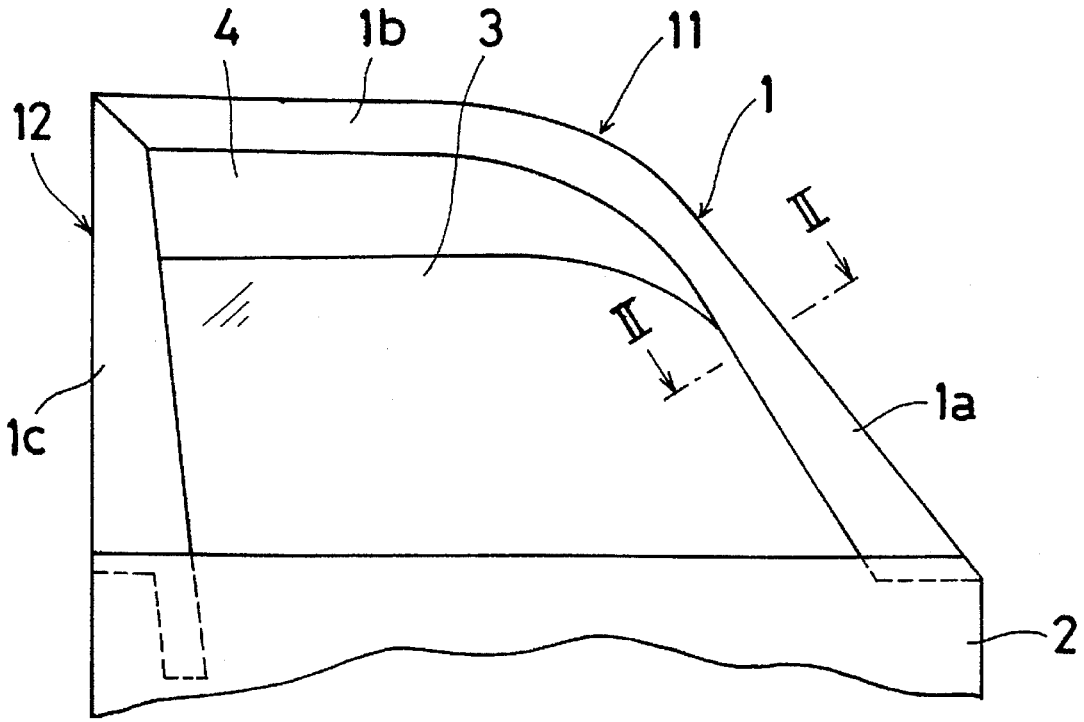
FIG. 1 is a fragmentary side elevation showing a vehicle door frame composed of roll formings produced by a method according to the present invention.

In FIG. 1, a vehicle door frame 1 defines a window 4 that is opened and closed by lowering a window pane 3 into a door 2 and raising the window pane 3 therefrom. The door frame 1 is generally formed by a member 11 forming a front portion 1*a* and a top portion 1*b* of the door frame 12, and another member 12 forming a pillar portion 1*c* disposed at the rear of the door frame 1. The two members 11 and 12 are connected to each other by welding, for example.

Figure 2:
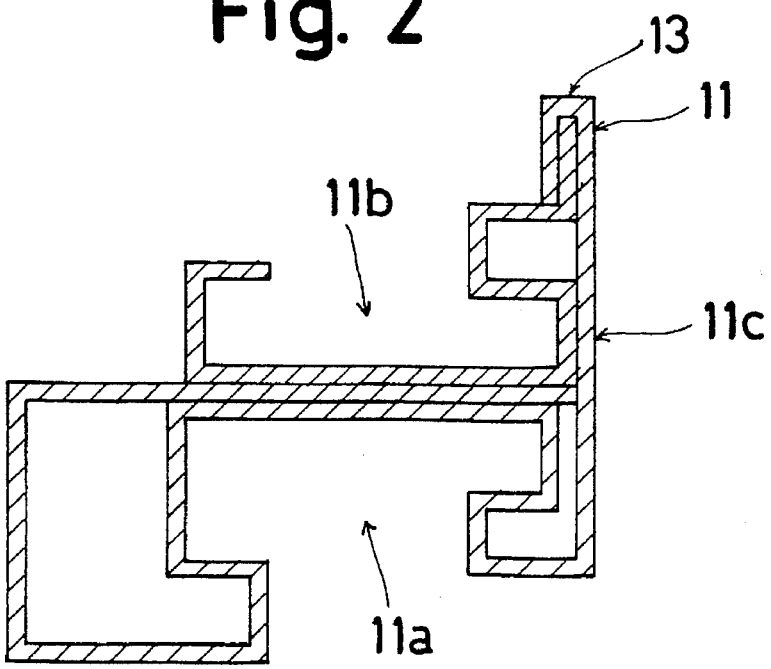
FIG. 2 is an enlarged cross section taken along line II—II of FIG. 1.

As shown in FIG. 2, the member 11 comprises a first support recess 11*a*, a second support recess 11*b* and a flat exterior portion 11*c*. Each of the first and second support recesses 11*a*, 11*b* has been formed by bending a portion of a sheet 14 (see FIG. 3) with respect to its width in a roll forming step A (described later) so that the portion has a generally "U"-shaped cross section. The first and second support recesses 11*a*, 11*b* are arranged so that the openings of the two recesses 11*a*, 11*b* face in opposite directions. The flat exterior portion 11*c* has been formed by bending the sheet 14 with respect to its width in the roll forming step A so that widthwise portions of the sheet 14 overlie each other. The flat exterior portion 11*c* extends generally in the directions of openings in the first and second support recesses 11*a*, 11*b*. The first support recess 11*a* supports a weather-stripping (not shown) that seals any gap between the member 11 and the window pane 3. The second support recess 11*b* supports another weather-stripping (not shown) that seals any gap between the frame member 11 and a vehicle body. The flat portion 11*c* defines the exterior of the vehicle door frame 1. A side edge of the flat exterior portion 11*c* has been formed into a hem 13 by a hemming roll forming step F (described later) so that the flat exterior portion 11*c* becomes wider toward the front end of the flat exterior portion 11*c*. Although not shown in detail, the other member 12 also comprises first and second support recesses and a flat exterior portion. A side edge of the flat exterior portion of the member 12 is hemmed in a manner slightly different from the manner in which the member 11 is hemmed.

Figure 3:
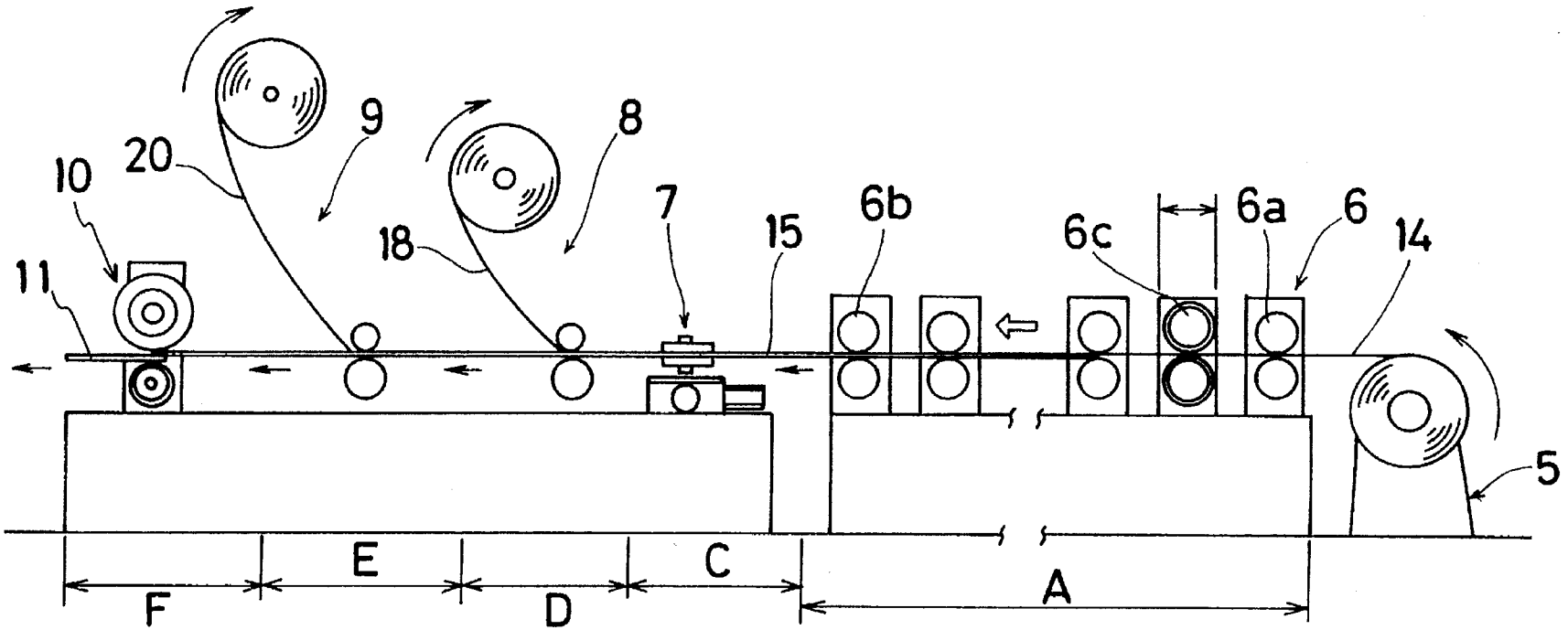
FIG. 3 is a schematic side elevation illustrating a production line according to the production method of the invention.

A production line for the member 11 will be described with reference to FIG. 3. A material support 5 is provided for supporting a coil of sheet material 14. Provided downstream of the material support 5 is a roll forming mill 6 comprising a plurality of rollers. Arranged downstream of the rolling mill stand 6 in the direction of production are a grooving mill 7 comprising rollers, two rippers 8, 9, and a hemming roll forming mill 10 comprising rollers.

Figure 4:
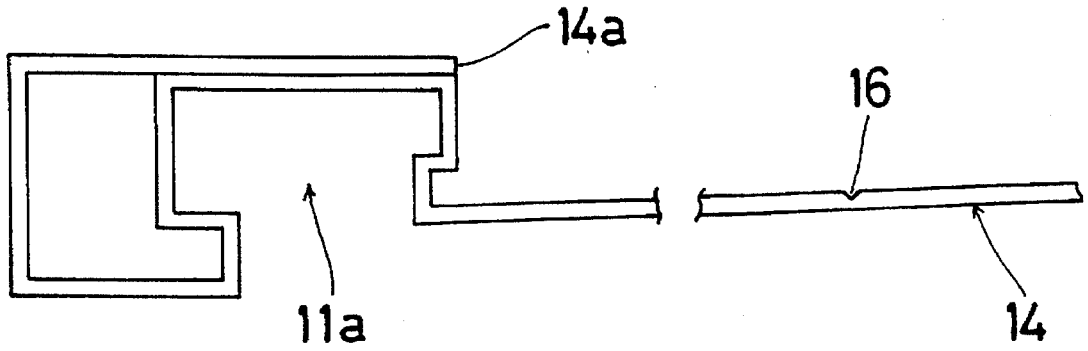
FIG. 4 is a sectional view of an unfinished metal sheet that has been processed in a first grooving step according to the method of the invention.
Figure 5:
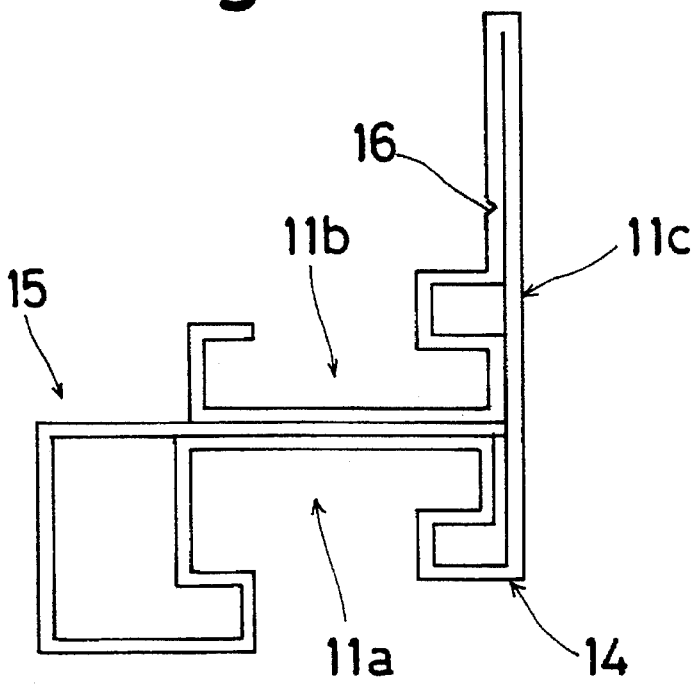
FIG. 5 is a sectional view of an intermediate sheet product that has been processed in a roll forming step according to the method of the invention.

A production method for the member 11 according to this embodiment will be described with reference to FIGS. 3–5. The coiled sheet 14 is conveyed through the roll forming mill 6, the grooving mill 7, the rippers 8, 9 and the hemming roll forming mill 10 so as to be sequentially processed by these mills.

When the sheet 14 is fed into the roll forming mill 6, the sheet 14 is gradually bent and folded starting from a side edge 14*a* by a series of rollers beginning with the first stage rollers 6*a* and ending with the final stage rollers 6*b*. More particularly, while conveying the sheet 14, the roll forming mill 6 sequentially forms the first support recess 11*a*, the flat exterior portion 11*c* and then the second support recess 11*b*, in that order, to provide an intermediate sheet product 15 having a sectional shape constituted by the first support recess 11*a*, the flat exterior portion 11*c* and the second support recess 11*b* as shown in FIG. 5 (roll forming step A). Rollers 6*c*, of a stage between the first and final stage rollers 6*a*, 6*b*, form a first "V"-shaped groove 16 as shown in FIGS. 4 and 5. The first groove 16 extends in a folded side edge portion of the flat exterior portion 11*c* obliquely to the side edge 14*a* (first groove forming step B).

Figure 6:
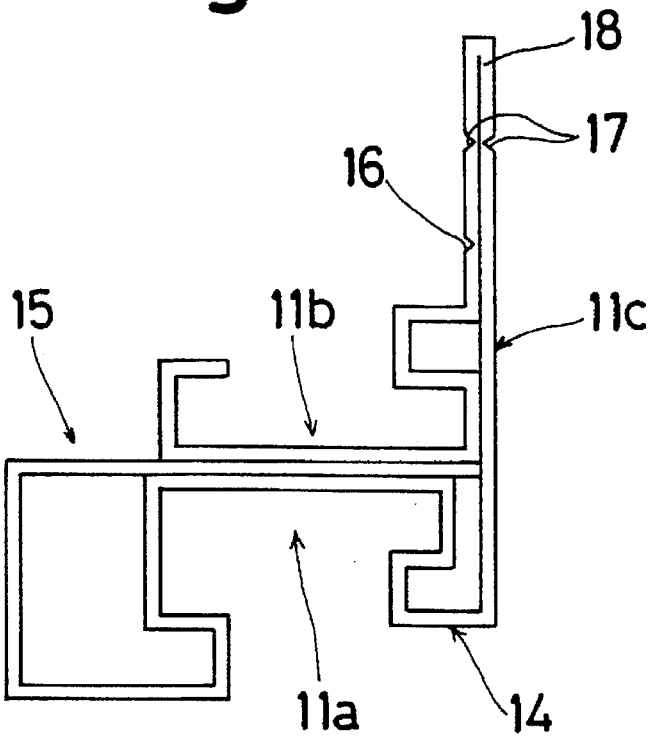
FIG. 6 is a sectional view of an intermediate sheet product that has been processed in: a second grooving step according to the method of the invention.

The intermediate sheet product 15 in the roll forming step A that includes the first grooving step B is then fed into the grooving mill 7 while an upstream portion of the sheet 14 is being processed by the roll forming mill 6. The grooving mill 7 forms a "V"-shaped groove 17 on each of the opposite surfaces of the folded side edge portion of the flat exterior portion 11*c* where portions of the sheet 14 are laid over each other by folding (second grooving step C), as shown in FIG. 6. The two second grooves 17 are formed in substantially the same position relative to the side edge of the flat exterior portion 11*c*. The two second grooves extend between the side edge of the flat exterior portion 11*c* and the first groove 16, parallel to the first groove 16, thus defining side strips 18 and 20 therebetween.

Figure 7:
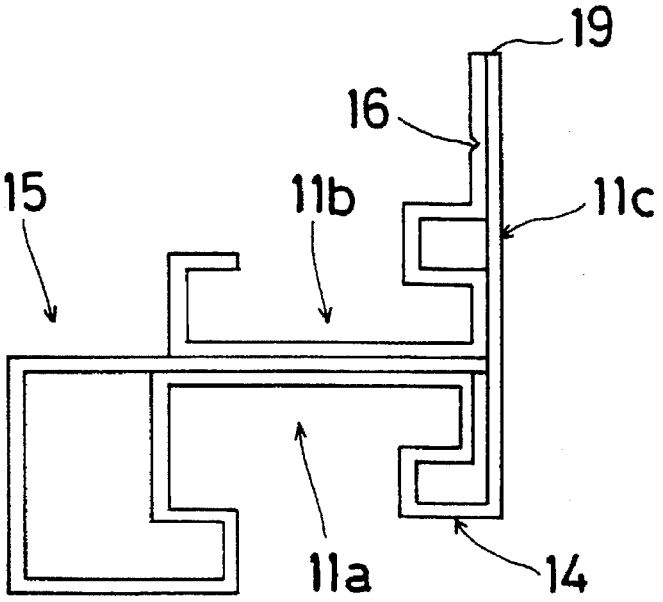
FIG. 7 is a sectional view of an intermediate sheet product that has been processed in a second ripping step according to the method of the invention.

The intermediate sheet product 15 processed by the roll forming step A and the second grooving step C is then fed into the ripper 8 while an upstream portion of the sheet 14 is in the roll forming step A. The ripper 8 tears off the side edge strip 18 along the second grooves 17 to provide the product 15 with a projecting edge 19 for hemming (first ripping step D), as shown in FIG. 7.

Figure 8A:
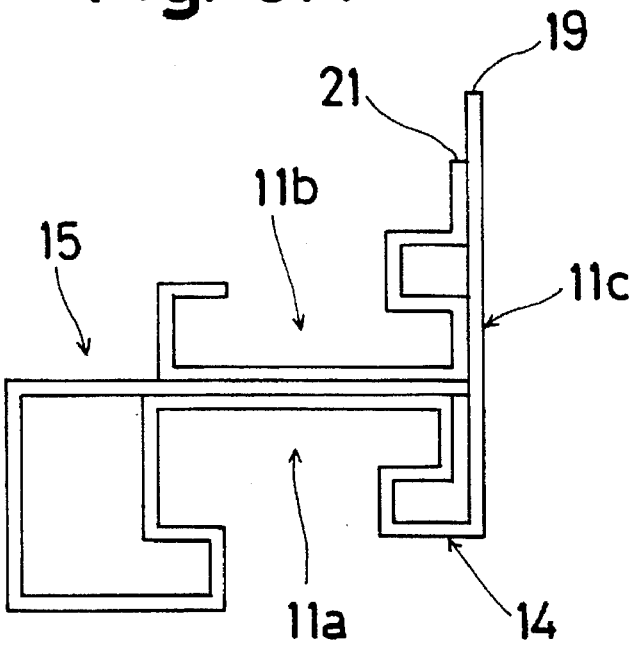
FIGS. 8*a* and 8*b* are respectively an end elevation and fragmentary prospective view illustrating a sheet product that has been processed in a first ripping step according to the method of the invention.
Figure 8B:
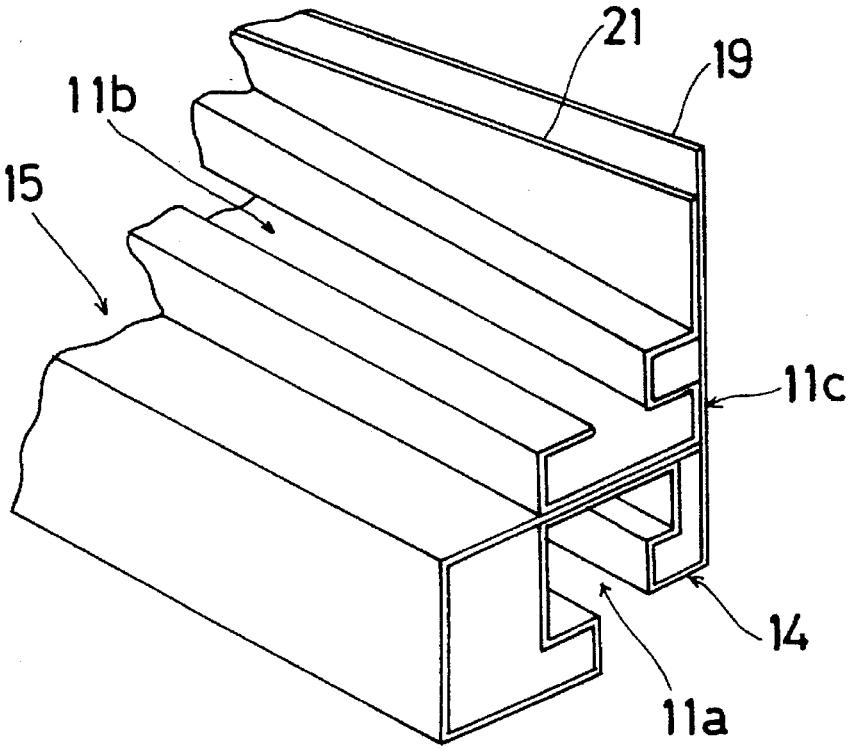
Figure 9A:
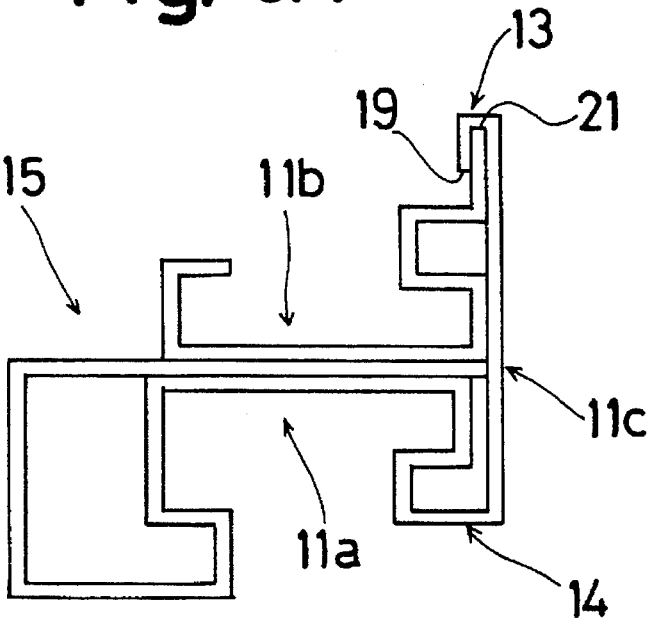
FIGS. 9*a* and 9*b* are respectively, an end elevation and fragmentary prospective view illustrating a final product that has been processed in a hemming step according to the method of the invention.
Figure 9B:
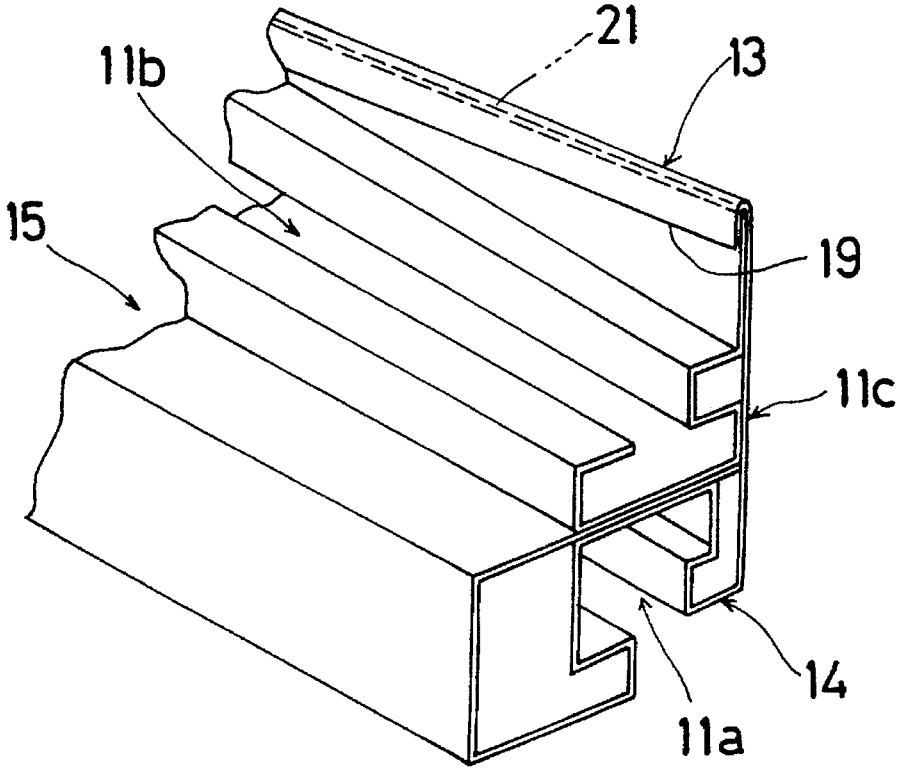

The sheet product 15 processed by the roll forming step A that includes the first grooving step B the second grooving step C and the second ripping step B is then fed into the downstream ripper 9 while an upstream portion of the sheet 14 is in the roll forming step A. The ripper 9 tears off the side edge strip 20 along the first groove 16 to provide the product 15 with a first edge 21 for hemming (second ripping step E), as shown in FIGS. 8*a*, 8*b*.

The intermediate sheet product 15 processed in the roll forming step A, the first grooving step B, the second grooving step C, the first ripping step D and the second ripping step E, is then fed into the hemming roll forming mill 10 while an upstream portion of the sheet 14 is in the roll forming step A. The hemming roll forming mill 10 bends the projecting edge portion 19 along the first edge 21 to provide the product 15 with a hem 13 (hemming step F). The hemming step F produces no gap between the bent portion of the projecting edge portion 19 and the first edge portion 21. The sheet 14 is thus formed into the final product 15. After the hemming step F, the product 15 is cut into a desired length by a cutter (not shown) to produce the member 11.

The member 11 is then curved by a suitable machine (not shown) to form the front portion la and the top portion 1*b* of the door frame 1.

The other member 12 is also produced by generally the same processing steps as for the member 11. The product 15 for the member 12 is cut into a desired length to produce the pillar portion 1*c* of the door frame 1.

In the above-described production method for the member 11 or 12, the first grooving step A may be conducted by a grooving mill separate from the roll forming mill 6 as in the second grooving step C. Alternatively, the second grooving step C may be conducted by the roll forming mill 6 as in the first grooving step C, by incorporating the grooving mill 7 into the roll forming mill 6. Furthermore, the first grooving step A and the second grooving step C may be performed in any sequence relative to the roll forming step A. For example, the first grooving step A and/or the second grooving step C may be performed prior to the roll forming step A. In addition, the first grooving step B may be performed simultaneously with the second grooving step C by incorporating the measures for forming the first groove 16 into the grooving mill 7.

As described above, the first ripping step tears off an unnecessary strip along the first groove formed by the first grooving step to form a first edge portion required for forming a hem by utilizing the sheet conveyance force provided by the roll forming step. Therefore, at least the first grooving step and the first ripping step can be performed contiguously with the roll forming step. In other words, the production method according to this embodiment allows a roll forming having a hem to be produced by a single continuous production line, thus significantly improving productivity.

Furthermore, since the projecting edge required for hemming that extends along the first edge for hemming is formed by the second grooving step (that may be included in the first grooving step) and the second ripping step in addition to the first grooving step and the first ripping step, the production method according to the embodiment can produce a hemmed roll forming without imposing any limitation on the sectional shape or degrading the design quality of the design surface of the product.

While the present invention has been described with reference to what is presently considered to be a preferred embodiment thereof, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for producing rolled structured shapes comprising:

a roll-forming step for bending a sheet into a sheet product having a predetermined sectional shape;

a grooving step for forming a groove at a predetermined location in the sheet product while a portion of the sheet product is being processed by the roll-forming step; and a removing step for tearing off a portion of the sheet product along the groove to form an edge portion while a portion of the sheet product is being processed by the roll-forming step.

2. A method for producing a rolled structural shape according to claim 1, further comprising a hem rolling step for forming a hem by bending a projecting edge portion while a portion of the sheet product is being processed by the roll-forming step.

3. A method for producing a roll forming according to claim 1, wherein the edge portion formed by said removing step is a first edge portion and the grooving step forms a second groove in a predetermined location in the sheet product, and wherein the method further comprises:

a second removing step for removing a portion defined by the second groove from the sheet product to form a projecting edge portion having a gradually changed sectional shape while a portion of the sheet product is being processed by the roll-forming step; and a hem rolling step of forming a hem by bending the projecting edge portion along the first edge portion while a portion of the sheet or the product is being processed by the roll-forming step.

4. A method for producing a rolled structural shape according to claim 1, further comprising:

a second grooving step for forming a second groove at a predetermined location in the sheet product while a portion of the sheet product is being processed by the roll- forming;

a second removing step for removing a portion defined by the second groove from the sheet product to form a projecting edge portion having a gradually changed sectional shape while a portion of the sheet product is being processed by the roll-forming step; and a hem rolling step for forming a hem by bending the projecting edge portion along the first edge portion while a portion of the sheet product is being processed by the roll-forming step.

5. A method for producing rolled structured shapes comprising:

a roll-forming step for bending a sheet into a sheet product having a predetermined sectional shape;

a grooving step for forming a groove at a predetermined location in the sheet product while a portion of the sheet product is being processed by the roll-forming step;

a removing step for removing a portion defined by the groove from the sheet product to form an edge portion having a gradually changed sectional shape while a portion of the sheet product is being processed by the roll-forming step; and a hem rolling step for forming a hem by bending a projecting edge portion while a portion of the sheet product is being processed by the roll-forming step.

6. A method for producing rolled structured shapes comprising:

a roll-forming step for bending a sheet into a sheet product having a predetermined sectional shape;

a grooving step for forming first and second grooves at respective predetermined locations in the sheet product while a portion of the sheet product is being processed by the roll-forming step;

a removing step for removing a portion defined by the first groove from the sheet product to form a first edge portion having a gradually changed sectional shape while a portion of the sheet product is being processed by the roll-forming step;

a second removing step for removing a portion defined by the second groove from the sheet product to form a projecting edge portion having a gradually changed sectional shape while a portion of the sheet product is being processed by the roll-forming step; and a hem rolling step of forming a hem by bending the projecting edge portion along the first edge portion while a portion of the sheet or the product is being processed by the roll-forming step.

7. A method for producing a rolled structural shape according to claim 6, wherein the roll-forming step bends the sheet in such a manner that the sheet product is provided with a first support recess having an opening, a second support recess having an opening opposite the opening of the first support recess, and a flat exterior portion including layered portions of the sheet, the flat exterior portion extending generally in the directions of the first support recess opening and the second support recess opening, and comprising a first grooving step for forming a first step in one of the opposite surfaces of the layered portion of the flat exterior portion, a second grooving step for forming the second groove in each of the opposite surfaces of a layered portion of the flat design portion, the second grooves extending near a side end of the flat design portion, the first groove being more remote from said side end of the flat design portion than the second grooves are spaced from the same side end of the flat exterior portion, and wherein said side end portion of the flat exterior portion is hemmed by the first removing step, the second removing step and the hem rolling step.

8. A method for producing rolled structured shapes comprising:

a roll-forming step for bending a sheet into a sheet product having a predetermined sectional shape;

a grooving step for forming a groove at a predetermined location in the sheet product while a portion of the sheet product is being processed by the roll-forming step;

a removing step for removing a portion defined by the groove from the sheet product to form an edge portion having a gradually changed sectional shape while a portion of the sheet product is being processed by the roll-forming step;

a second grooving step for forming a second groove at a predetermined location in the sheet product while a portion of the sheet product is being processed by the roll-forming;

a second removing step for removing a portion defined by the second groove from the sheet product to form a projecting edge portion having a gradually changed sectional shape while a portion of the sheet product is being processed by the roll-forming step; and a hem rolling step for forming a hem by bending the projecting edge portion along the first edge portion while a portion of the sheet product is being processed by the roll-forming step.

* * * * *